US006966409B2

(12) United States Patent
Wang

(10) Patent No.: US 6,966,409 B2
(45) Date of Patent: Nov. 22, 2005

(54) BACKUP POWER DEVICE FOR ELEVATOR

(76) Inventor: Jiun Jyh Wang, No.50, Alley 97, Lane 354, San Her Rd., Feng Yuan, Taichung Hsien (TW)

( * ) Notice: Subject to any disclaimer, the term of this patent is extended or adjusted under 35 U.S.C. 154(b) by 252 days.

(21) Appl. No.: 10/658,855

(22) Filed: Sep. 9, 2003

(65) Prior Publication Data

US 2005/0051388 A1 Mar. 10, 2005

(51) Int. Cl.[7] ..... B66B 1/06

(52) U.S. Cl. ..... 187/290; 187/314; 187/263; 187/377

(58) Field of Search ..... 187/290, 314, 187/254, 263, 377, 350, 351, 356, 359, 266, 187/414, 311, 312; 188/188, 189

(56) References Cited

U.S. PATENT DOCUMENTS 5,680,911 A * 10/1997 Wang ..... 187/263
5,890,565 A * 4/1999 Wang ..... 187/263
5,971,109 A * 10/1999 Aulanko et al. ..... 187/263
6,273,216 B1 * 8/2001 Kocher et al. ..... 187/377
6,464,043 B2 * 10/2002 Wang ..... 187/314
6,561,318 B1 * 5/2003 Lamb ..... 187/263

FOREIGN PATENT DOCUMENTS

JP 03036185 A * 2/1991 ..... B66B 9/02

* cited by examiner

*Primary Examiner*—Jonathan Salata
(74) *Attorney, Agent, or Firm*—Pro-Techtor Int'l Services

(57) ABSTRACT

Backup power device for an elevator comprises a brake including a brake controller and a manual brake rod, a damping assembly including a roller at one end of a lever, and a wheel having alternate recesses and risers, an electro-magnetic controller having a control rod, a pulley having a rope run through the manual brake rod and the control rod, an electro-magnetic brake actuator, and a backup power supply. A passenger trapped in the car can pull down the rope in case of the failure of the electro-magnetic controller, the electro-magnetic brake actuator, and the backup power supply as the lever turns to cause the roller to contact the recess or the riser. The lever moves intermittently to cause the manual brake rod to activate the brake controller for braking and releasing a motor shaft again in intervals. Eventually, the passenger can escape.

2 Claims, 6 Drawing Sheets

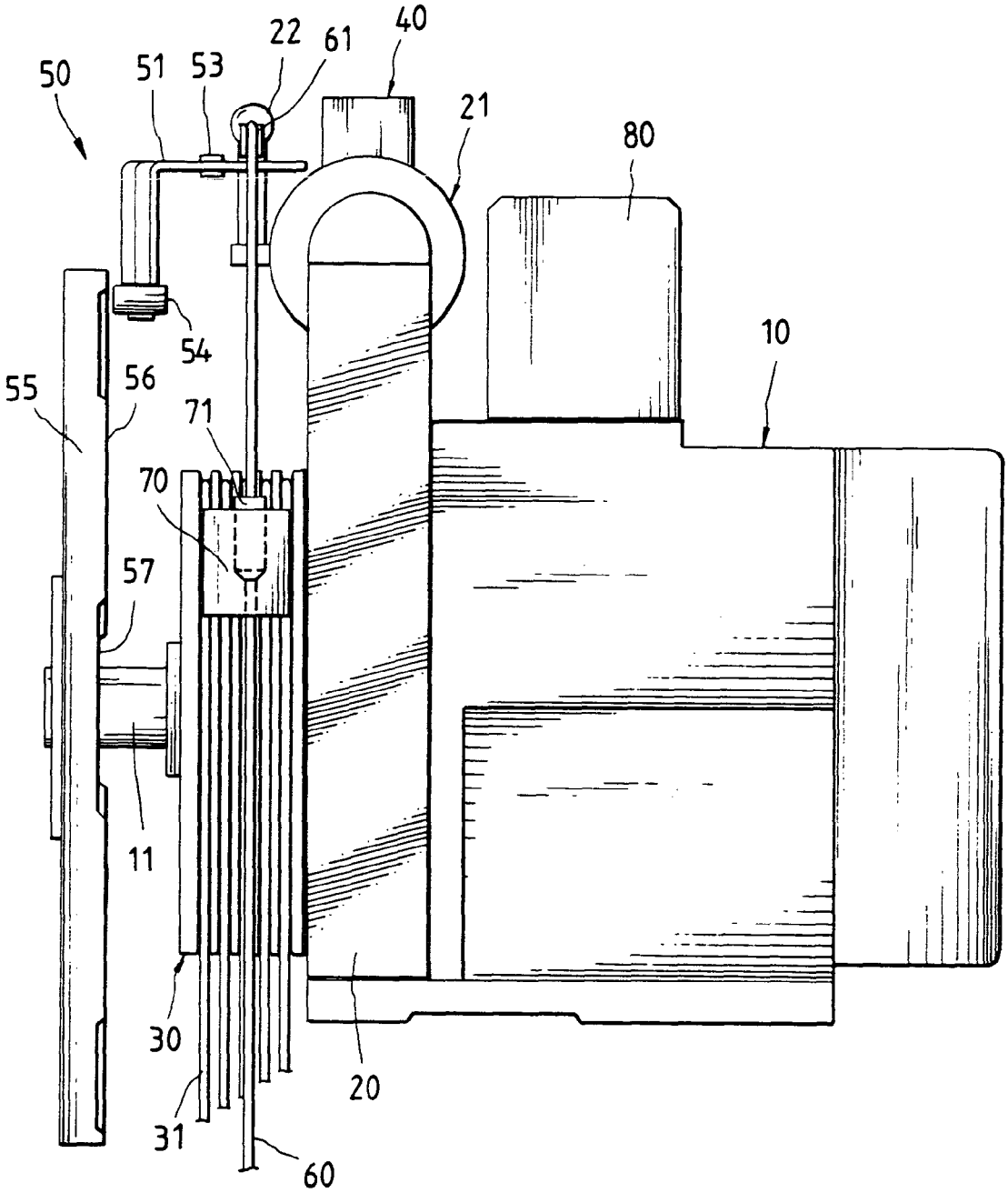
FIG, 1

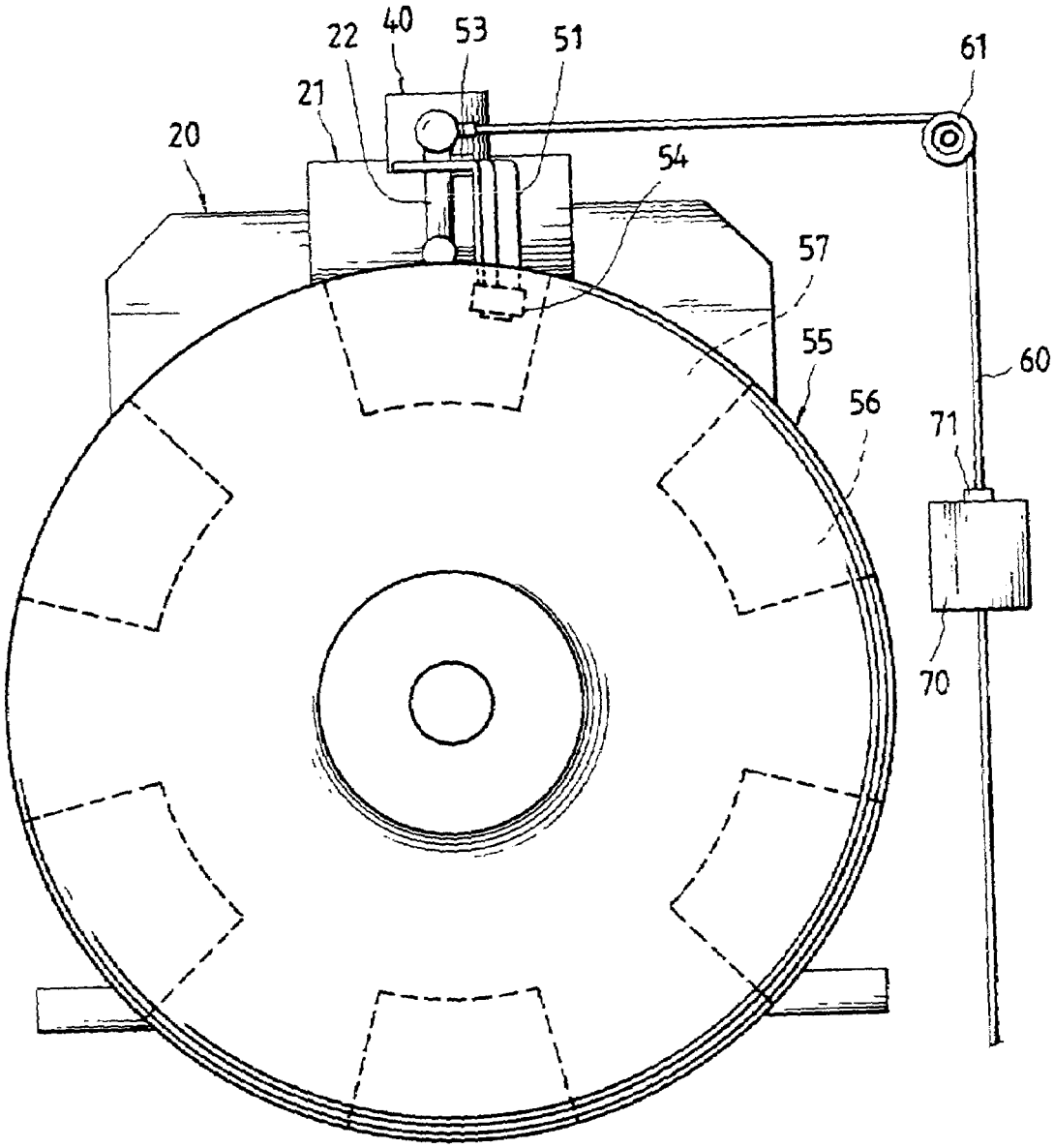
FIG, 2

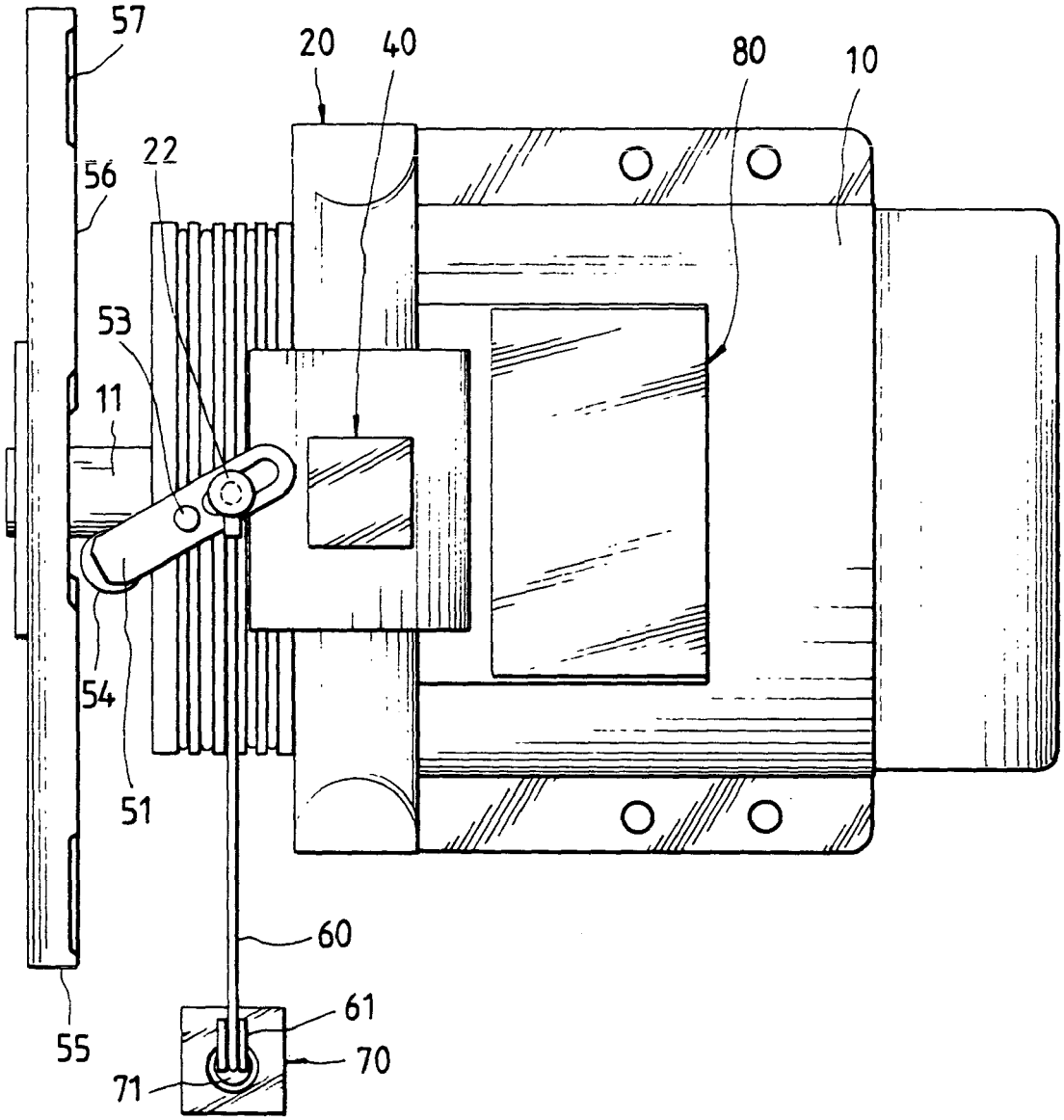
FIG, 3

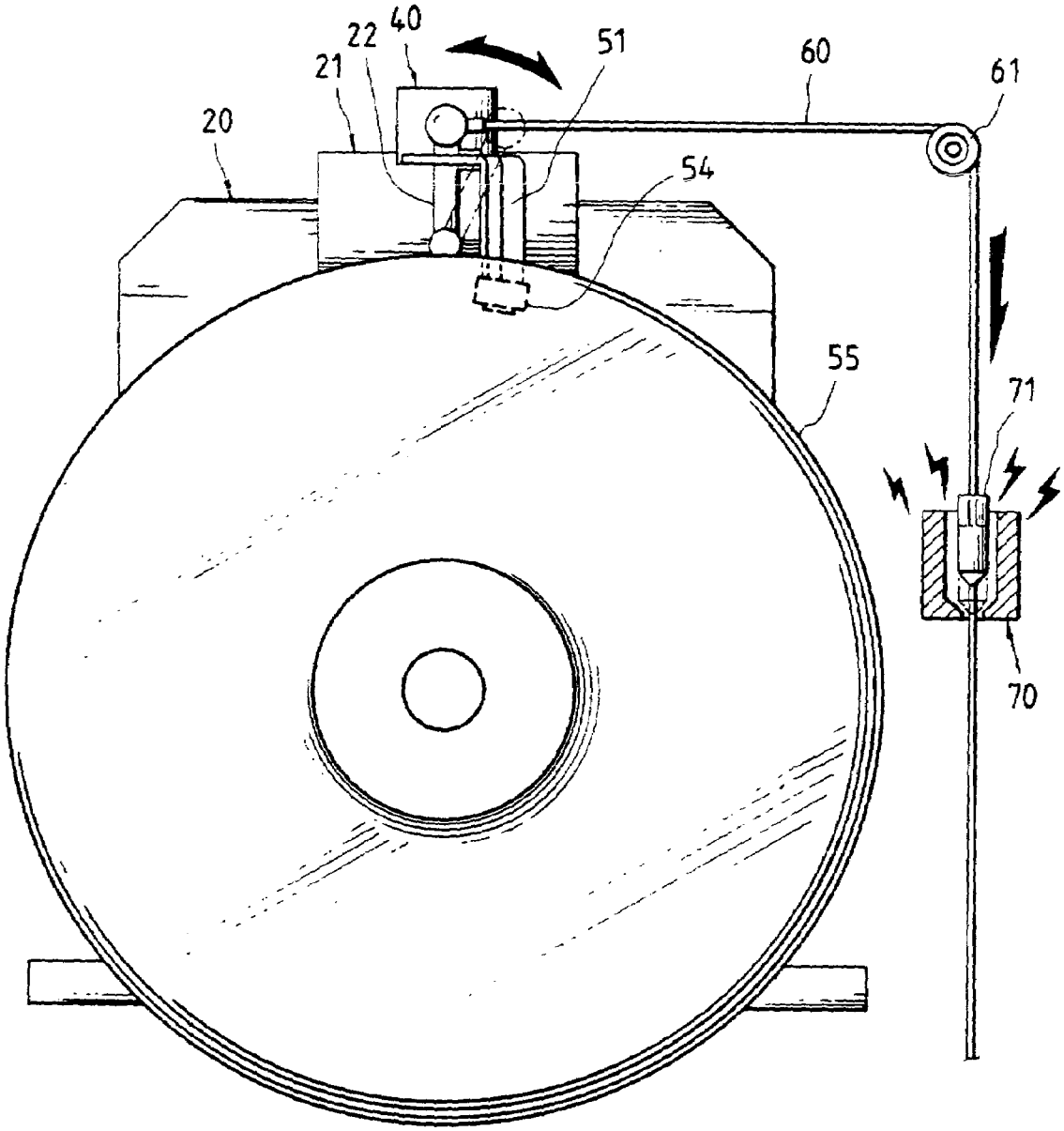
FIG, 4

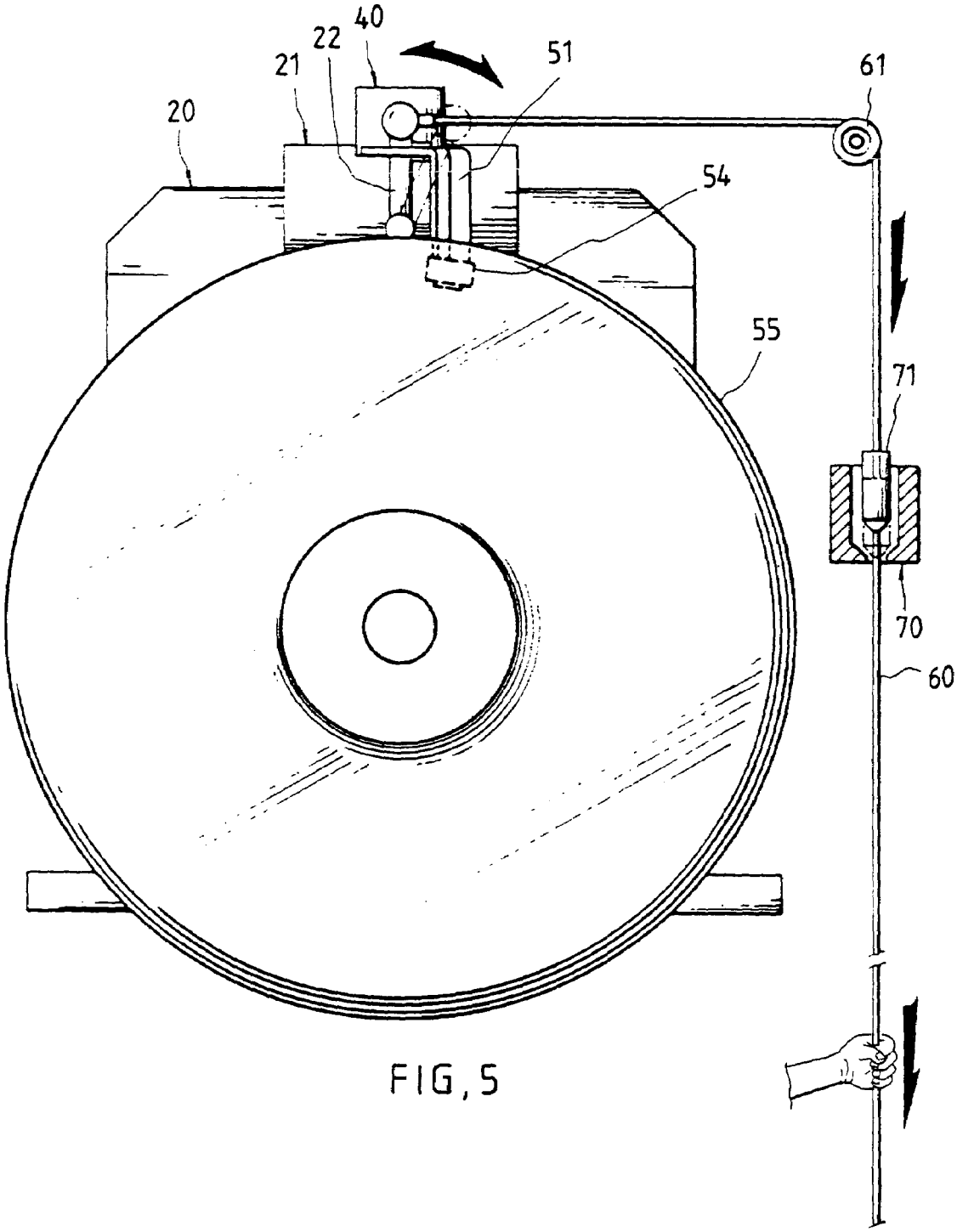
FIG, 5

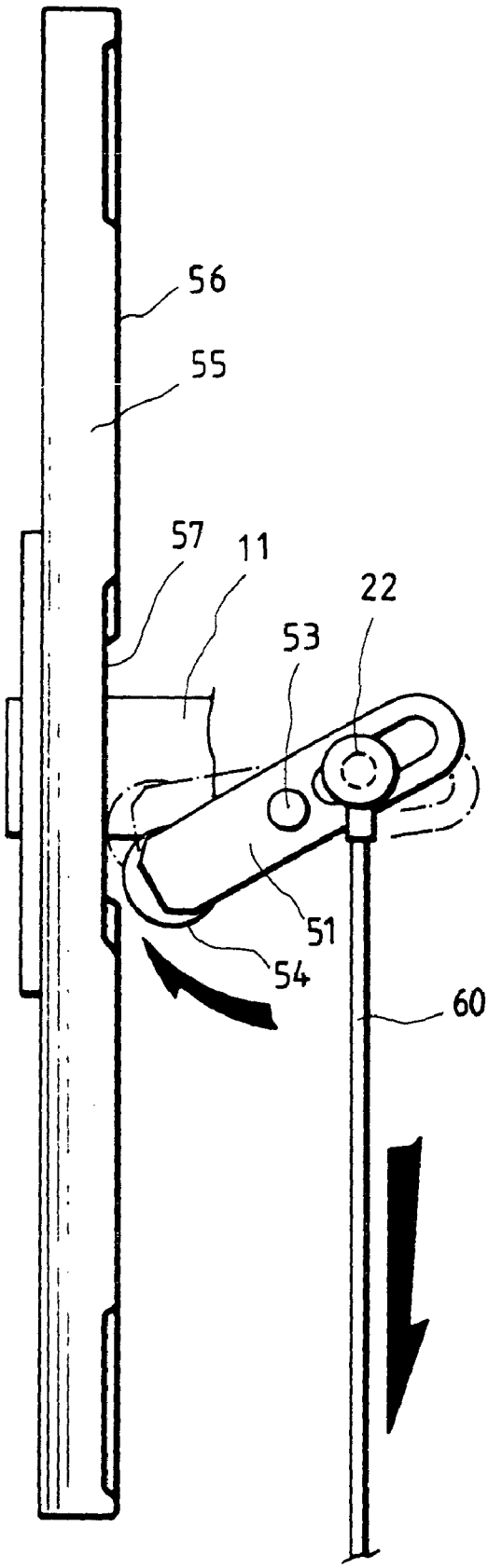
FIG, 6

BACKUP POWER DEVICE FOR ELEVATOR

BACKGROUND OF THE INVENTION

1. Field of the Invention

The present invention relates to safety device of elevator and more particularly to a backup power device being automatically or manually operable in case of the failure of the elevator.

2. Description of Related Art

Conventionally, the speed of an elevator motor is regulated by a frequency changer circuit. Also, a car safety device is required to install in the elevator as a backup power device in case of the failure of the elevator (e.g., particularly one having a motor regulated by a frequency changer circuit). Unfortunately, the car still may fall freely if the car safety device also breakdowns in case of the failure of the elevator. Hence, a need for improvement exists.

SUMMARY OF THE INVENTION

It is an object of the present invention to provide a backup power device for an elevator, comprising a brake including an upper brake controller and a manual brake rod; a damping assembly including a lever spaced apart from a top peripheral portion and coupled to the manual brake rod, the lever having a fulcrum, a roller at one end of the lever, and a wheel having a plurality of alternate recesses and risers equally spaced apart around its periphery; a motor including a shaft extended outwardly through the brake and the sheave to rotatably couple to the wheel, the shaft being controlled by the brake controller; a sheave having a traveling cable run through, the sheave and the traveling cable being operative to rotate as the shaft rotates; an electro-magnetic controller having a control rod; a pulley having a rope run through the manual brake rod and the control rod to extend downward; an electro-magnetic brake actuator on top of the brake controller; and a backup power supply; wherein the brake controller will activate automatically to brake the shaft in case of the failure of the elevator, the backup power supply will be enabled to supply power to the electro-magnetic brake actuator for activation, the brake controller, as driven by the electro-magnetic brake actuator, will operate intermittently to cause the brake to brake and release the shaft again in intervals, and the shaft will rotate slowly to hoist or lower a car of the elevator until a bottom of the car is flush with a proximate floor of a building; the electro-magnetic controller, as powered by the backup power supply, will activate automatically in case of the failure of the electro-magnetic brake actuator, the electro-magnetic controller will brake and release the control rod again in intervals, the rope will be driven to pull the manual brake rod to cause the brake controller to activate the brake, the brake will brake and release the shaft again in intervals, and the shaft will rotate slowly to hoist or lower the car until the bottom of the car is flush with the proximate floor of the building; or a passenger trapped in the car can pull down the rope in case of the failure of the electro-magnetic controller, the electro-magnetic brake actuator, and the backup power supply, the manual brake rod is lowered, the lever will turn about the fulcrum to cause the roller to contact the recess or the riser, the wheel turns as the shaft rotates slowly, the roller will rotate and move laterally, intermittently as the alternate recesses and risers rotate, the lever will turn about the fulcrum to cause the manual brake rod to move intermittently to activate the brake controller for causing the brake to brake and release the shaft again in intervals, and the shaft will rotate slowly to hoist or lower the car until the bottom of the car is flush with the proximate floor of the building.

In one aspect of the present invention, the backup power supply is one of a rechargeable battery, an uninterrupted power supply (UPS), and an alternator.

The above and other objects, features and advantages of the present invention will become apparent from the following detailed description taken with the accompanying drawings.

BRIEF DESCRIPTION OF THE DRAWINGS

FIG. 1 is a side plan view of a power device of elevator incorporating a backup power device according to the invention;

FIG. 2 is a front plan view of FIG. 1;

FIG. 3 is a top plan view of FIG. 1;

FIG. 4 is a view similar to FIG. 2 for illustrating an operation of the backup power device;

FIG. 5 is a view similar to FIG. 2 for illustrating another operation of the backup power device; and FIG. 6 is a top plan view showing an enlarged portion of the coupled damping assembly, the manual brake rod, and the rope for illustrating still another operation thereof.

DETAILED DESCRIPTION OF THE PREFERRED EMBODIMENTS

Referring to FIGS. 1, 2 and 3, there is shown a power device of elevator incorporating a backup power device constructed in accordance with the invention. The backup power device comprises a brake 20 including an upper brake controller 21, a sheave 30, a damping assembly 50, and a motor 10 including a shaft 11 extended outwardly through the brake 20 and the sheave 30 to rotatably couple to the damping assembly 50. The shaft 11 is controlled by the brake controller 21. Both the sheave 30 and a traveling cable 31 thereof rotate as the shaft 11 rotates. As an end, the elevator hoists or lowers.

The backup power device further comprises an electro-magnetic brake actuator 40 on top of the brake controller 21. The damping assembly 50 comprises a lever 51 spaced apart from a top peripheral portion and coupled to a manual brake rod 22 of the brake 20, the lever 51 having a central fulcrum 53, a roller 54 at a lower end of the lever 51, and a wheel 55 having a plurality of alternate recesses 57 and risers 56 equally spaced apart around its periphery. A rope 60 runs through a pulley 61, the manual brake rod 22 and a control rod 71 of an electro-magnetic controller 70 to extend downward. The electro-magnetic controller 70 and the electro-magnetic brake actuator 40 are powered by a backup power supply 80 (e.g., rechargeable battery, uninterrupted power supply (UPS), or alternator).

The brake controller 21 will activate automatically to brake the shaft 11 in case of the failure of the elevator while hoisting or lowering. Immediately, the backup power supply 80 will be enabled to supply power to the electro-magnetic brake actuator 40 for activation. The brake controller 21, as driven by the electro-magnetic brake actuator 40, will operate intermittently. As such, the brake 20, as driven by the brake controller 21, will brake and release the shaft 11 again in intervals. Hence, the shaft 11 will rotate slowly to hoist or lower the car until the bottom of the car is flush with a proximate floor of a building. At this moment, passenger(s) trapped in the car can escape safely.

Referring to FIGS. 4, 5, and 6 the electro-magnetic controller 70, as powered by the backup power supply 80, will activate automatically to operate the elevator in case of the failure of the electro-magnetic brake actuator 40. The electro-magnetic controller 70 will brake and release the control rod 71 again in intervals. As such, the rope 60 will be driven to pull the manual brake rod 22 to cause the brake controller 21 to activate the brake 20. Next, the brake 20 will brake and release the shaft 11 again in intervals. Hence, the shaft 11 will rotate slowly to hoist or lower the car until the bottom of the car is flush with a proximate floor of a building. At this moment, passenger(s) trapped in the car can escape safely.

The passenger trapped in the car can pull down the rope 60 in case of the failure of the electro-magnetic controller 70, the electro-magnetic brake actuator 40, and the backup power supply 80 as shown in FIG. 6. The manual brake rod 22 is lowered accordingly. Also, the lever 51 will turn about the fulcrum 53 to cause the roller 54 at one end of the lever 51 to contact the recess 56 (or riser 57) of the wheel 55. At the same time, the wheel 55 turns as the shaft 11 rotates slowly. Hence, the roller 54 will rotate and move laterally, intermittently as the alternate recesses 56 and risers 57 rotate. And in turn, the lever 51 will turn about the fulcrum 53 to cause the manual brake rod 22 to move intermittently to activate the brake controller 21. Thus, the brake 20, as driven by the brake controller 21, will brake and release the shaft 11 again in intervals. Hence, the shaft 11 will rotate slowly to hoist or lower the car until the bottom of the car is flush with a proximate floor of a building. At this moment, passenger(s) trapped in the car can escape safely.

While the invention herein disclosed has been described by means of specific embodiments, numerous modifications and variations could be made thereto by those skilled in the art without departing from the scope and spirit of the invention set forth in the claims.

What is claimed is:

1. A backup power device for an elevator, comprising:

a brake including an upper brake controller and a manual brake rod;

a damping assembly including a lever spaced apart from a top peripheral portion and coupled to the manual brake rod, the lever having a fulcrum, a roller at one end of the lever, and a wheel having a plurality of alternate recesses and risers equally spaced apart around its periphery;

a motor including a shaft extended outwardly through the brake and the sheave to rotatably couple to the wheel, the shaft being controlled by the brake controller;

a sheave having a traveling cable run through, the sheave and the traveling cable being operative to rotate as the shaft rotates;

an electro-magnetic controller having a control rod;

a pulley having a rope run through the manual brake rod and the control rod to extend downward;

an electro-magnetic brake actuator on top of the brake controller; and a backup power supply; wherein the brake controller will activate automatically to brake the shaft in case of the failure of the elevator, the backup power supply will be enabled to supply power to the electro-magnetic brake actuator for activation, the brake controller, as driven by the electro-magnetic brake actuator, will operate intermittently to cause the brake to brake and release the shaft again in intervals, and the shaft will rotate slowly to hoist or lower a car of the elevator until a bottom of the car is flush with a proximate floor of a building;

the electro-magnetic controller, as powered by the backup power supply, will activate automatically in case of the failure of the electro-magnetic brake actuator, the electro-magnetic controller will brake and release the control rod again in intervals, the rope will be driven to pull the manual brake rod to cause the brake controller to activate the brake, the brake will brake and release the shaft again in intervals, and the shaft will rotate slowly to hoist or lower the car until the bottom of the car is flush with the proximate floor of the building; or a passenger trapped in the car can pull down the rope in case of the failure of the electro-magnetic controller, the electro-magnetic brake actuator, and the backup power supply, the manual brake rod is lowered, the lever will turn about the fulcrum to cause the roller to contact the recess or the riser, the wheel turns as the shaft rotates slowly, the roller will rotate and move laterally, intermittently as the alternate recesses and risers rotate, the lever will turn about the fulcrum to cause the manual brake rod to move intermittently to activate the brake controller for causing the brake to brake and release the shaft again in intervals, and the shaft will rotate slowly to hoist or lower the car until the bottom of the car is flush with the proximate floor of the building.

2. The backup power device of claim 1, wherein the backup power supply is one of a rechargeable battery, an uninterrupted power supply (UPS), and an alternator.

* * * * *